US005271614A

United States Patent [19]

Yamada et al.

[11] Patent Number: 5,271,614

[45] Date of Patent: Dec. 21, 1993

[54] SHEET SUPPLYING DEVICE

[75] Inventors: Yoshikado Yamada, Kashihara; Yoshiteru Mori, Kita-Katsuragi; Hideo Taniguchi, Yamato-Koriyama, all of Japan

[73] Assignee: Sharp Kabushiki Kaisha, Osaka, Japan

[21] Appl. No.: 946,035

[22] Filed: Sep. 15, 1992

Related U.S. Application Data

[63] Continuation of Ser. No. 770,135, Oct. 2, 1991, abandoned, which is a continuation of Ser. No. 515,740, Apr. 30, 1990, abandoned.

[30] Foreign Application Priority Data

May 9, 1989 [JP] Japan ..... 1-116437

[51] Int. Cl.[5] ..... B65H 3/44

[52] U.S. Cl. ..... 271/9

[58] Field of Search ..... 271/9, 127, 157, 162, 271/164, 171, 175, 241, 252–255, 265

[56] References Cited

U.S. PATENT DOCUMENTS

| | | | |
|---|---|---|---|
| 4,763,889 | 8/1988 | Dei et al. | 271/9 |
| 4,809,050 | 2/1989 | Ito | 271/9 |
| 4,958,822 | 9/1990 | Rutishauser et al. | 271/9 |
| 4,998,137 | 3/1991 | Ida et al. . | |
| 5,003,493 | 3/1991 | Okada et al. | 271/262 X |

FOREIGN PATENT DOCUMENTS

| | | | |
|---|---|---|---|
| 56-59245 | 5/1981 | Japan . | |
| 59-123859 | 7/1984 | Japan . | |
| 262735 | 12/1985 | Japan | 271/145 |
| 195099 | 7/1986 | Japan | 271/145 |
| 192637 | 8/1986 | Japan | 271/9 |
| 82250 | 4/1988 | Japan | 271/9 |

OTHER PUBLICATIONS

Patent Abstracts—"Variable Magnetification Image Forming Device" (11) 56-59245(A); Canon K.K. (72) Masaji Suda(1)—76 p. 73.

*Primary Examiner*—Robert P. Olszewski
*Assistant Examiner*—Boris Milef
*Attorney, Agent, or Firm*—Nixon & Vanderhye

[57] ABSTRACT

A sheet supplying device supplies a sheet to a sheet supplied apparatus which designates the size and transport direction of the sheet. The sheet supplying device includes a transport path for transporting therethrough the sheet to the sheet supplied apparatus, a movable cassette for placing the sheet and movable to at least two transport positions so as to transport the sheet in at least two transport directions, and a fixed cassette for placing the sheet and fixed in one transport position so as to transport the sheet in one transport direction. The sheet supplying device further includes a control device for selecting either the movable cassette or the fixed cassette and for ordering the movable cassette to move to a transport position corresponding to the designated transport direction. The sheet supplying device also includes a transport device for transporting the sheet from the selected cassette through the transport path.

6 Claims, 6 Drawing Sheets

SHEET SUPPLYING DEVICE

This is a continuation of application Ser. No. 07/770,135, filed Oct. 2, 1991, now abandoned, which in turn was a continuation of application Ser. No. 07/515,740, filed Apr. 30, 1990, now abandoned.

RELATED APPLICATIONS

This application is related to commonly assigned copending applications: Ser. No. 07/521,726, filed May 10, 1990, now U.S. Pat. No. 5,096,178 Ser. No. 07/523,800 filed May 15, 1990, now U.S. Pat. No. 5,083,967 Ser. No. 07/521,692 filed May 10, 1990 now U.S. Pat. No. 4,998,137 and Ser. No. 07/521,693 filed May 10, 1990 now U.S. Pat. No. 5,065,995.

BACKGROUND OF THE INVENTION

Field of the Invention

The present invention relates to a sheet feeding device for use in a copier, a printer and the like.

Description of the Related Art

An apparatus supplied with a sheet material, for example, a copier which is supplied with copying sheets, such as paper, is provided with a sheet feeding device. The sheet feeding device is provided with a plurality of sheet feeding cassettes with each cassette corresponding to a plurality of sizes of the sheet. A lateral transport for transporting a sheet in the direction of its width is more preferable in view of the transport speed than a longitudinal transport for transporting a sheet in its longitudinal direction. There exists a copier which enables the lateral transport of even large-sized sheets such as B4- and A3-sized sheets.

On the contrary, in order to transport such a large-sized sheet in the lateral direction, it is required that the photoconductive drum, the transport roller, the transport path, etc. in the copier are also large, resulting in the increase of size and cost of the copier. Therefore, a method is preferably used for transporting a large-sized sheet, such as B4-, A3-sized sheets, in the longitudinal direction, while transporting a small-sized sheets, such as sheets of not larger than A4-size, in the lateral direction.

However, in the case, for example, where the copier has a variable magnification function for reducing or enlarging an image, the copier needs B5R- and A4R-sheet cassettes for a longitudinal transport in a reduction copying operation, and further needs B5- and A4-sheet cassettes for a lateral transport in a normal copying operation in consideration of the transport speed. If such various types of cassettes are used in the copier, it is required that the sheet supplying device shall be large to accommodate all of those cassettes, or that one of those cassettes shall be selected and exchanged at the sheet supplying device according to the purpose of each copying operation. As a result, this makes the copier large and thus increases the cost, or complicates the copying operation and thus increases the operation time.

Thus, in order to solve the above problem, a conventional sheet supplying device has been proposed, wherein a common cassette is used for supplying a same sized sheet in two different transport directions, for example, a common cassette for B5 and B5R and a common cassette for A4 and A4R are used, and the switching between the lateral transport and the longitudinal transport is done by turning the cassette, as disclosed in the Japanese Patent Application Laying Open (KOKAI) No. 56-59245, No. 59-123859, etc.

However, in the above conventional supplying device, the following problem arises: that is, in case that the same sized sheets are stacked in both a turning cassette, which is capable of turning between a longitudinal transport position for transporting the sheet in the longitudinal direction and a lateral transport position for transporting the sheet in the lateral direction, and a fixed cassette, which is fixed at either the longitudinal transport position or the lateral transport position, when a sheet of this same size is selected, it is not considered which cassette should be selected for supplying the sheet therefrom in view of transport distance or transport time. As a result, the supplying speed of the sheet is yet not sufficient.

SUMMARY OF THE INVENTION

An object of the present invention is to provide a sheet feeding device which can supply a sheet quickly.

According to the present invention, the above object can be achieved by a sheet feeding device for supplying a sheet to a sheet supplied apparatus which designates the size and transport orientation of the sheet. The sheet feeding device includes a transport path for transporting therethrough the sheet to the sheet supplied apparatus, a movable sheet placing means having a plane for placing the sheet thereon and movable to at least two transport positions so as to transport the sheet therefrom in at least two transport orientations, and a fixed sheet placing means having a plane for placing the sheet thereon and fixed in one transport position so as to transport the sheet therefrom in one transport orientation. The sheet supplying device further includes a control device for selecting, when the size and transport orientation of the sheet placed on the fixed sheet placing means correspond to the designated size and transport orientation and when the size of the sheet placed on the movable sheet placing means corresponds to the designated size, either the movable sheet placing means or the fixed sheet placing means whose transport path to the sheet supplied apparatus is the shorter, and for further ordering the movable sheet placing means to move to a transport position corresponding to the designated transport orientation if the selected sheet placing means is the movable sheet placing means and the transport position of the movable sheet placing means does not correspond to the designated transport orientation. The sheet supplying device also includes a transport device for transporting the sheet from the selected sheet placing means through the transport path.

According to the above sheet feeding device, for example, in case of supplying a sheet such as a sheet of paper to the sheet supplied apparatus such as a copier, when a supply of A4-sized sheet in a lateral direction is designated by the sheet supplied apparatus, if there are a fixed sheet placing means, which places A4-sized sheets thereon and is at a lateral transport position, and a movable sheet placing means which places A4-sized sheets thereon, the control device selects the sheet placing means whose transport path to the sheet supplied apparatus is the shorter of the two sheet placing means.

If the selected sheet placing means is the movable sheet placing means and the movable sheet placing means is at a longitudinal transport position, the movable sheet placing means moves to a lateral transport position in response to the order from the control device. After the movable sheet placing means moves thus, the sheet is transported from the movable sheet placing means by the transport device through the transport path.

On the contrary, if the movable sheet placing mean sis selected and is at a lateral transport position, the movable sheet placing means does not move and the sheet is transported from the movable sheet placing means by the transport device through the transport path.

If the fixed sheet placing means is selected, the sheet is transported from the fixed sheet placing means by the transport device through the transport path.

According to the present invention as described above, since the sheet is transported through the minimum portion of the transport path, the transport time can be shortened to the minimum and the sheet can be transported quickly. Accordingly, the sheet supplying device of the present invention can supply a sheet quickly. For, example, if the sheet supplied apparatus is a copier, the copying speed for the first sheet in each copying operation can be increased.

DETAILED DESCRIPTION OF THE PREFERRED EMBODIMENT

Referring to the accompanying drawings, an embodiment of the present invention will be now explained.

Figure 1:
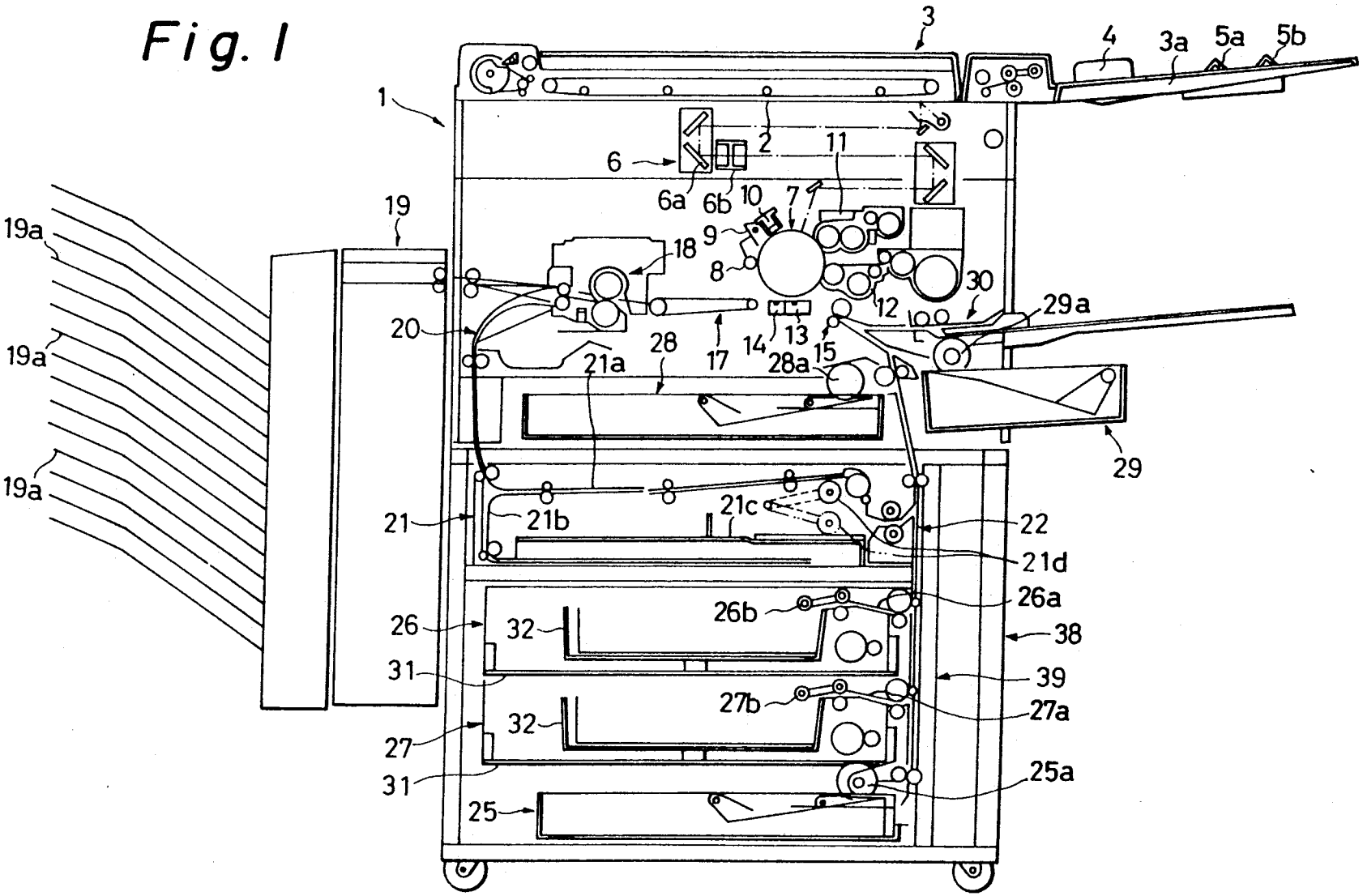
FIG. 1 is a general view showing the overall configuration of a copier provided with a sheet feeding device according to an embodiment of the present invention.

As shown in FIG. 1, a copier comprises a desk section 38 under a main body 1, which is a sheet material supplied apparatus, a sorter 19 on the paper eject side of the main body 1, and an automatic document feeding device (referred to as ADF hereinafter) 3 on the main body 1.

The main body 1 includes a first fixed cassette 29, and a second fixed cassette 28.

Figure 2:
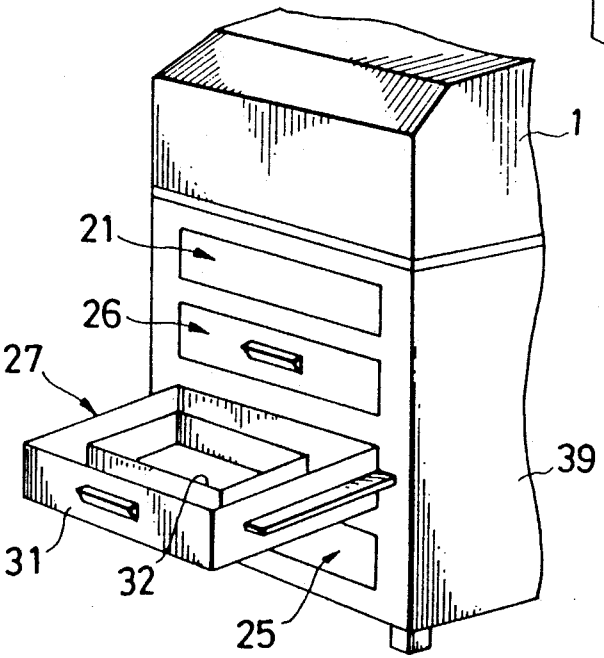
FIG. 2 is a perspective view showing that a second turning cassette unit of the copier as shown in FIG. 1 is drawn out.

The desk section 38, as shown in FIG. 2, includes a both sides composition unit 21, a first turning cassette unit 26, a second turning cassette unit 27, and a third fixed cassette 25 in a positional order starting from the top of the desk section 38.

Each of the first and second turning cassette units 26, 27 has a movable turning cassette 32 as an example of a movable sheet placing means in each outer housing 31.

The first, second and third fixed cassette 29, 28, 25 are examples of a fixed sheet placing means. The movable cassettes 32 and the fixed cassettes 25, 28, 29 are thus provided to a sheet feeding device 39 as an example of a sheet supplying device.

The ADF 3 is located on a document table glass 2 of the main body 1. The ADF 3 transports a document, not shown, laid on a document table 3*a* to a predetermined position on the document table glass 2 in response to its size and longitudinal or lateral transport direction, and ejects the document after the document is copied. Furthermore, the ADF 3 transports the document to the predetermined position on the document table glass 2 again after turning the document upside down in case that both sides copying of the document is to be performed. After the other side is copied, the document is then ejected.

Mounted on the document table 3*a*, are transport direction switches 5*a*, 5*b* for detecting the size of the document in the transport direction and a guide 4 for limiting both edges of the document in the direction of the width of the document. The guide 4 is provided with a width direction switch, not shown, for detecting the size of the document in the direction of its width.

Located below the document table glass 2 is an optical system 6, composed of a plurality of reflective mirrors 6*a* and lenses 6*b*. The fundamental function of the optical system 6 is to direct a reflective light from the document to a photoconductive drum 7. Besides that, the optical system 6 has a variable magnification function, that is, it has a composition which enables enlargement and reduction copying as well as equivalent magnification copying to be performed.

Around the photoconductive drum 7, are arranged a cleaner 8, a discharger 9, a charger 10, a developing device 11 containing a toner for color development, and a developing device 12 containing a black toner. These means and the above optical system 6 execute a series of processes, that is, charging, exposing, developing, removing of residual toner and discharging, for the photoconductive drum 7.

Below the photoconductive drum 7, there is arranged a transfer charger 13, by which a toner image on the photoconductive drum 7 is transferred onto the sheet supplied to the photoconductive drum 7, and a separation charger 14, by which the above sheet is separated from the photoconductive drum 7. Then, the sheet is transported by means of a transport belt 17 to a fixing device 18. The fixing device 18 fixes the toner image on the sheet by heat or pressure.

Though the sheet transported in the fixing device 18 is normally ejected onto eject trays 19*a*, through a sorter 19, if both sides copying or composition copying is to be performed, the sheet is led through a sheet return path 20 to the composition unit 21. In the both sides copying operation, the sheet is turned upside down onto an intermediate tray 21*c* after passing through a first transport path 21*a* in the composition unit 21, and then the sheet is fed to a sheet feed transport path 22 by a feeding roller 21*d*. In the composition copying operation, after the sheet is transported to a second transport path 21*b* in the composition unit 21 and its rear edge is detected in the second transport path 21*b*, the sheet is fed forward by a switchback with the previous rear edge now being the front edge. The sheet is turned upside down onto the intermediate tray 21*c* after passing through the first transport path 21*a*, and then, fed to the sheet feed transport path 22 by the feeding roller 21*d*.

The sheet feed transport path 22 extends to the vicinity of the photoconductive drum 7 and is provided with a paper stop roller 15 at the rear end portion thereof for timing the rotation of the photoconductive drum 7 and the feeding of the sheet. To the sheet feed transport path 22 are connected a plurality of sheet feeding means, from which the sheet is properly supplied. Concretely, this plurality of sheet feeding means include a manual sheet feeding section 30, a first fixed cassette 29 capable of containing at most 500 sheets, a second fixed cassette 28 capable of containing at most 250 sheets, the composition unit 21, the first turning cassette unit 26, the second turning cassette unit 27, and the third fixed cassette 25 containing at most 250 sheets. The length of the sheet transport path from each of the respective sheet feeding means to the paper stop roller 15 increases the closer the respective sheet feeding means is located to the bottom of the desk section 38. The first fixed cassette 29 and the second fixed cassette 28 arranged in the main body 1 and the composition unit 21, the first turning cassette unit 26, the second turning cassette unit 27 and the third fixed cassette 25 arranged in the desk section 38, constitute a group of cassettes in the sheet feeding device 39. Each of the above fixed cassettes 29, 28, 25 and the turning cassettes unit 26, 27 is detachably mounted and provided with a transporting device 29*a*, 28*a*, 25*a*, 26*a*, 27*a* respectively for taking and transporting the sheet from each cassette to the transport path 22.

Figure 3:
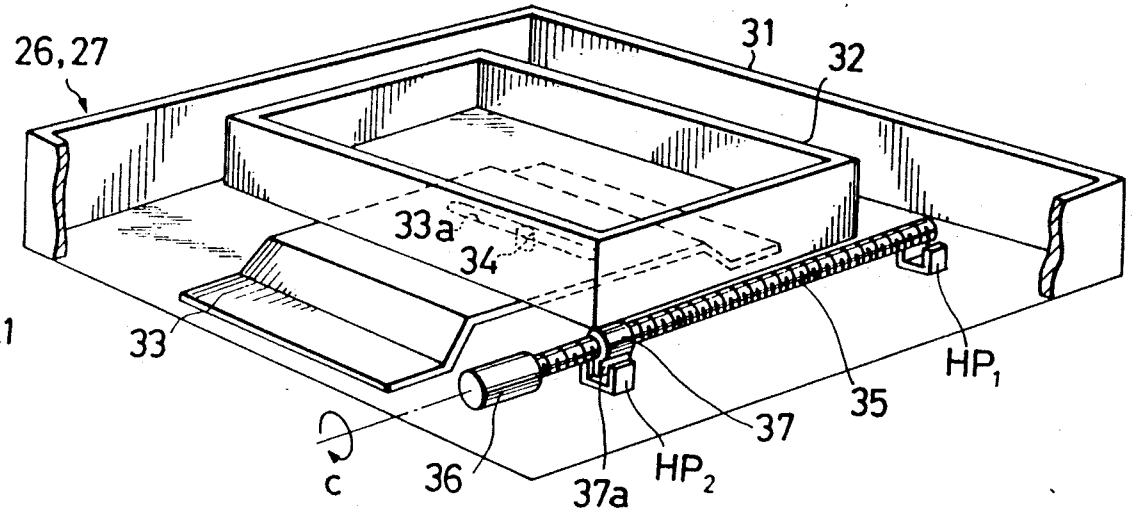
FIG. 3 is a perspective fragmentary sectional view of a first and a second turning cassette units as shown in FIG. 1.

As shown in FIG. 3, each of the first and second turning cassette units 26, 27 includes the outer housing 31 and a turning cassette 32 containing sheets of a predetermined size. The turning cassette 32 is provided with a turning plate, not shown, for lifting the sheets in the turning cassette 32 in response to the reduction of the sheets. On the bottom plate of the outer housing 31, is mounted a cassette supporting plate 33 whose center portion is apart from the bottom plate of the outer housing 31. A guide aperture 33*a*, which is elongated in the direction for feeding the sheet, is formed on the center portion of the cassette supporting plate 33. From the center portion of the lower side of the turning cassette 32, a guide axis 34 projects downward so as to engage the guide aperture 33*a*. The guide axis 34 is adapted to slide in the guide aperture 33*a*.

Figure 4:
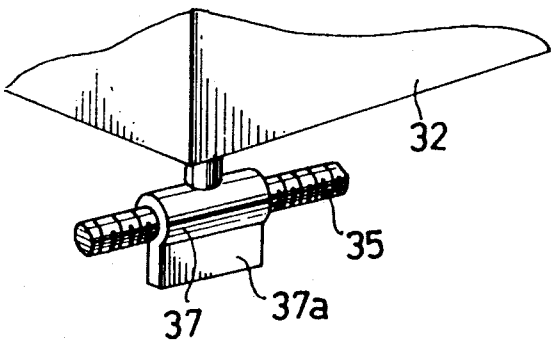
FIG. 4 is an enlarged perspective view of a nut member portion as shown in FIG. 3.

Furthermore, the outer housing 31 is provided with a threaded shaft 35 in parallel relationship with a feeding plane vertical to the direction for feeding the sheet from the turning cassette 32 and the bottom plate of the outer housing 32. The threaded shaft 35 is supported by a bearing, not shown, and rotatable in two directions by connecting one of its edges to a cassette turning motor 36. A nut member 37 is engaged with the threaded shaft 35 so that the nut member 37 can reciprocate in the axial direction associated with the rotation of the threaded shaft 35 in two directions. As shown in FIG. 4, a top portion of the nut member 37 is rotatably connected to one of a corner portion of the turning cassette 32. At a bottom portion of the nut member 37, a shading plate 37*a* is formed.

On the bottom plate of the outer housing 31 below the vicinity of each end of the threaded shaft 35, there is mounted a lateral transport position sensor HP1, which detects the state where the turning cassette 32 is turned and moved to a predetermined lateral transport position, and a longitudinal transport position sensor HP2, which detects the state where the turning cassette 32 is turned moved to a longitudinal transport position, respectively. Each of the two sensors is composed of a light emitting element and a light receiving element. When the turning cassette 32 is moved to the predetermined lateral and longitudinal transport positions, the shading plate 37*a* interrupts the light being emitted from the light emitting element to the light receiving element, and thereby the position sensors HP1, HP2 detect the movement of the turning cassette 32 to the predetermined position. The position sensors HP1, HP2 may be not only photointerrupters but also magnetic sensors, contact type switches and so on.

Figure 5:
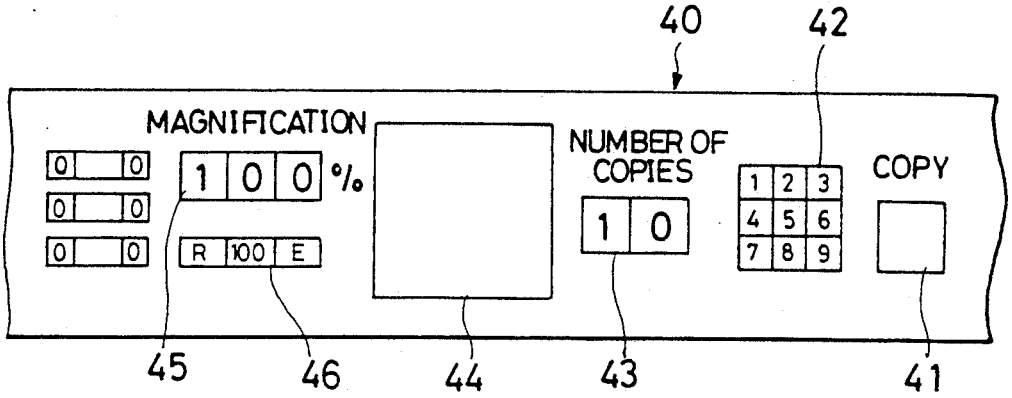
FIG. 5 is a front view of an operation panel of the copier as shown in FIG. 1.

The main body 1 of the copier is provided with an operation panel 40 on its upper surface, as shown in FIG. 5.

The operation panel 40 comprises a copy button 41 for directing the start of a copying operation, ten keys 42 for setting the number of copies and so on, a copy number display 43, a cassette operation section 44, a magnification display 45, magnification setting keys 46, etc.

Figure 6:
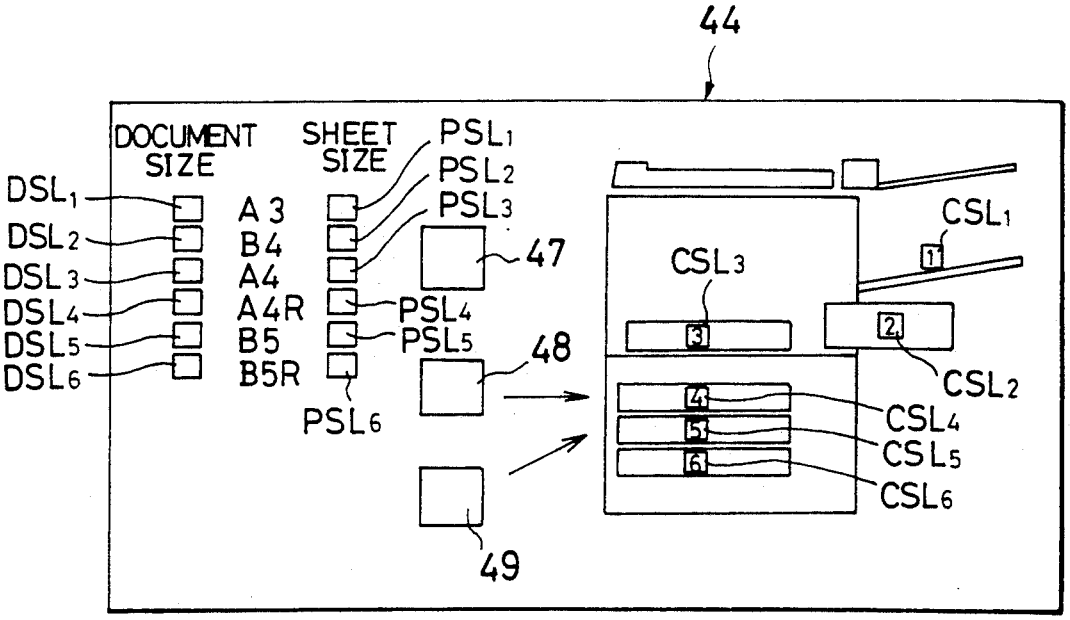
FIG. 6 is a front view of a cassette operation section of the operation panel as shown in FIG. 5.

The cassette operation section 44 comprises, as shown in FIG. 6, a cassette switch key 47 for selecting a cassette, a cassette turning key 48 for directing the turning of the turning cassette 32 in the first turning cassette unit 26, and a cassette turning key 49 for directing the turning of the turning cassette 32 in the second turning cassette unit 27. Furthermore, the cassette operation section 44 comprises document size display lamps DSL1 to DSL6, sheet size display lamps PSL1 to PSL6 and cassette display lamps CSL1 to CSL6 displaying the manual sheet feeding section 30, the first fixed cassette 29, the second fixed cassette 28, the first turning cassette unit 26, the second turning cassette unit 27, and the third fixed cassette 25 as respectively numerals 1 to 6 in the above order. These cassette display lamps CSL1 to CSL6 are turned ON when the cassette switch key 47 is operated and either one of the turning cassettes 26, 27, any of the fixed cassettes 25, 28, 29, or the manual sheet feeding section 30 is selected. For example, if the first turning cassette unit 26 is selected in response to the operation of the cassette switch key 47, the cassette display lamp CSL4 is turned ON and further, if the A4-sized sheets are stacked in the turning cassette 32 of the first turning cassette unit 26, the sheet size display lamp PSL3 is turned ON to display that the sheet is A4-sized. In this case, when the cassette turning key 48 is operated, the turning cassette 32 is turned from the lateral transport position to the longitudinal transport position and the sheet size display lamp PSL4 is turned ON to display that the sheet is A4R-sized. If no sheet is stacked in the turning cassette units 26, 27, the fixed cassettes 25, 28, 29, or the manual sheet feeding section 30, the sheet size display lamps PSL1 to PSL6 are not turned ON.

Figure 7:
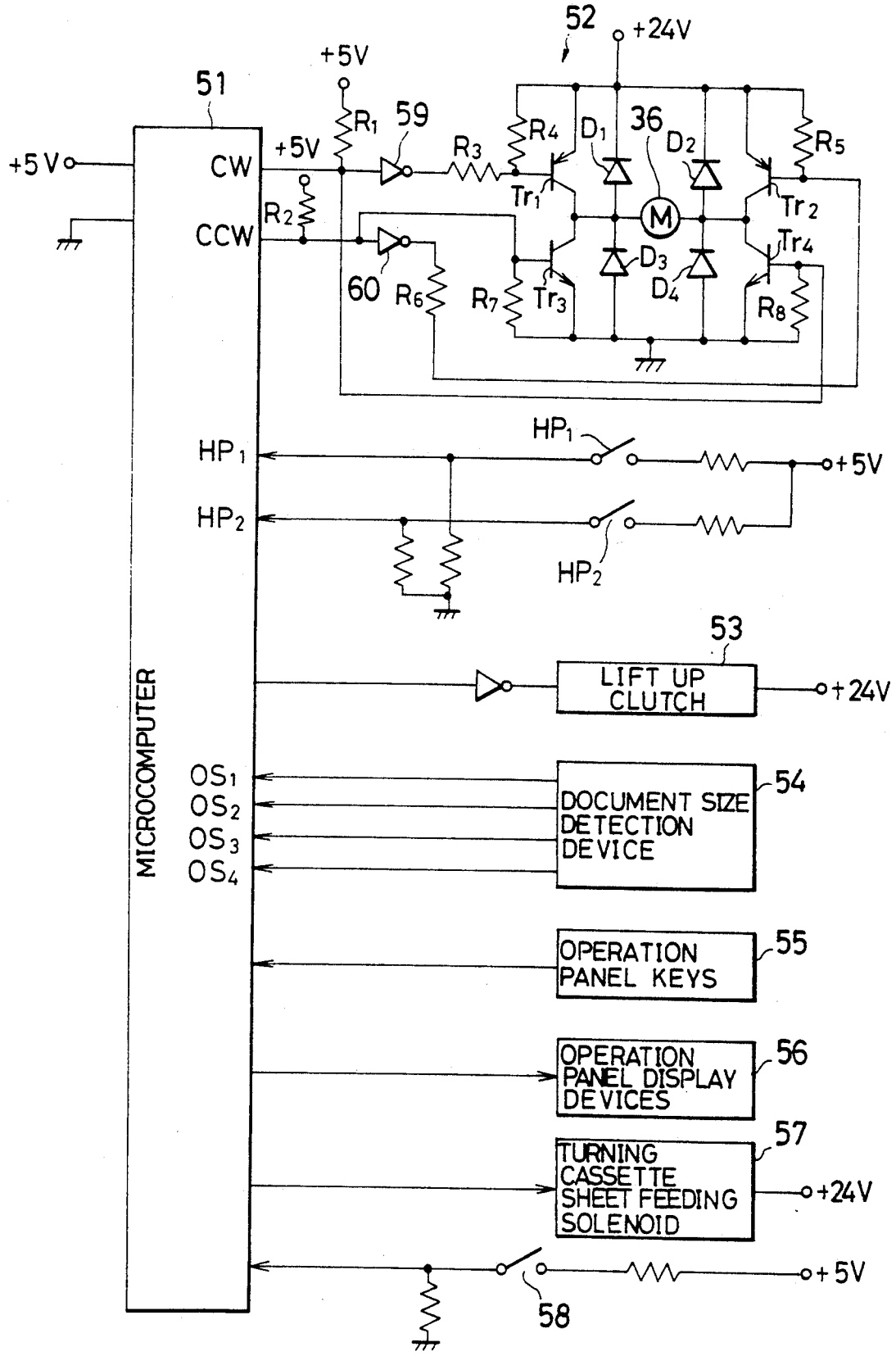
FIG. 7 is a block diagram of a control device of the sheet feeding device as shown in FIG. 1.

As shown in FIG. 7 the sheet feeding device 39 includes a microcomputer 51 as a control means. To the above microcomputer 51, are connected a motor driver circuit 52, the position sensors HP1, HP2, a lift-up clutch 53, a document size detection device 54, operation panel keys 55, operation panel display devices 56, a turning cassette unit feeding solenoid 57, a sheet insert detection switch 58, etc. Accordingly, the sheet feeding device 39 is equipped with the fixed cassettes 29, 28, 25, the composition unit 21, the turning cassette units 26, 27, the transport device 29*a*, 28*a*, 25*a*, 26*a*, 27*a*, the microcomputer 51, the motor driver circuit 52, and the cassette turning motor 36.

The motor driver circuit 52 and the cassette turning motor 36 constitute a cassette turning driving means and, though not shown in FIG. 7, they are provided in the first and second turning cassette units 26, 27 respectively. The motor driver circuit 52 is composed of pull-up resistors R1, R2, NOT circuits 59, 60, transistors Tr1 to Tr4, resistors R3 to R8, and diodes D1 to D4 as surge absorbers, and drives the cassette turning motor 36 in two directions of rotation in response to the output of the microcomputer 51. The pull-up resistor R1, an input port of the NOT circuit 59 and a base of the transistor Tr4 are connected to an output terminal CW and an output port of the NOT circuit 59 is connected to a base of the transistor Tr1 through the resistor R3. To the base of the transistor Tr1, and end of the resistor R4 is connected, and to a base of the transistor Tr2, and end of the resistor R5 is connected. The other ends of these resistors R4 and R5, emitters of the transistors Tr1 and Tr2 and cathodes of the diodes D1 and D2 are connected to one another. The points where they are connected have a voltage of +24 V applied to them. Furthermore, a collector of the transistor Tr1 and an anode of the diode D1 are connected to one of the input terminals of the cassette turning motor 36. A collector of the transistor Tr2 and an anode of the diode D2 are connected to the other input terminal of the cassette turning motor 36. On the other hand, the pull-up resistor R2, an input port of the NOT circuit 60 and a base of the transistor Tr3 are connected to an output terminal CCW of the microcomputer 51. An output port of the NOT circuit 60 is connected to a base of the transistor Tr2 through the resistor R6. To the base of the transistor Tr3, an end of the resistor R7 is connected. To a base of the transistor Tr4, an end of the resistor R8 is connected. The other ends of these resistors R7 and R8, emitters of the transistors Tr3 and Tr4 and anodes of the diodes D3 and D4 are connected to one another. The points where they are connected have a voltage of +24 V applied to them. Furthermore, a collector of the transistor Tr3 and a cathode of the diode D3 are connected to one of the input terminals of the cassette turning motor 36. A collector of the transistor Tr4 and a cathode of the diode D4 are connected to the other input terminal of the cassette turning motor 36.

In the above motor driver circuit 52, the turning cassette 32 of the first turning cassette unit 26 or the second turning cassette unit 27 is turned to the lateral transport position, for example, an A4 position or a B5 position, when the output terminal CCW of the microcomputer 51 is at a high level (the output terminal CW remains LOW), and to the longitudinal transport position, for example, an A4R position or a B5R position, when the output terminal CW is at a high level.

The lift-up clutch 53 is mounted so as to interrupt the transmission of the driving force to a lift plate for moving the turning plate in the turning cassette 32 up and down.

The document size detection device 54 is composed of a width direction switch, not shown, mounted on the guide 4 for the document table 3*a* and the transport direction switches 5*a*, 5*b* and located so as to supply input terminals OS1 to OS4 of the microcomputer 51 with 4-bit data.

The operation panel keys 55 are the copy button 41, the ten keys 42, the magnification setting key 46, the cassette switch key 47, the cassette turning keys 48, 49 and so on.

The operation panel display device 56 is composed of the copy number display 43, the magnification display 45, the document size display lamps DSL1 to DSL6, the sheet size display lamps PSL1 to PSL6, cassette display lamps CSL1 to CSL6, etc. provided on the operation panel 40.

The turning cassette sheet feeding solenoid 57 is mounted so as to drive each of a taking roller 26*b* in the transport device 26*a* of the first turning cassette unit 26 and a taking roller 27*b* in the transport device 27*a* of the second turning cassette unit 27 to feed the sheet through the transport path 22.

The insert detection switch 58 is located immediately in front of the paper stop roller 15 shown in FIG. 1 so as to detect the arrival of the sheet at the paper stop roller 15.

When any key of the operation panel keys 55 is operated, the microcomputer 51 performs the control in response to the operation. For example, when the cassette turning key 48 corresponding to the first turning cassette unit 26 is operated so as to direct the turn of the turning cassette 32 in the first turning cassette unit 26 from the lateral transport position to the longitudinal transport position, the output terminal CW is turned to a high level and the output terminal CCW is turned to a low level, while, if the key operation directs the turn from the longitudinal transport position to the lateral transport position, the output terminal CCW is turned to a high level and the output terminal CW is turned to a low level. When the turning cassette 32 is moved to the lateral transport position and the cassette position sensor HP1 is turned ON, that is, the light in the photointerrupter is interrupted, the output terminal CCW is turned to a low level at once and the cassette turning motor 36 is stopped. In the same way, when the turning cassette 32 is moved to the longitudinal transport position and the cassette position sensor HP2 is turned ON, the output terminal CW is turned to a low level and the cassette turning motor 36 is stopped.

The microcomputer 51 also has an automatic sheet selection function for determining the size of the document based on the 4-bit data input from the document size detection device 54, lighting either of the document size display lamps DSL1 to DSL6, which corresponds to the discriminated size, and automatically selecting the cassette which contains the sheets corresponding to the document size. In addition, as described later with reference to FIG. 9, the microcomputer 51 selects the cassette containing the selected sheets with the above automatic sheet selection function and controls the automatic turn of the first or second turning cassette unit 26, 27 by changing an output level of the output terminals CW and CCW. The microcomputer 51 stores the order of the length of the sheet transport paths, for transporting the sheet to the paper stop roller 15, starting from the shortest and also stores the size and transport direction of the sheets stacked in each of the fixed cassettes 29, 28, 25 and each turning cassette 32 of the turning cassette units 26, 27.

Figure 8:
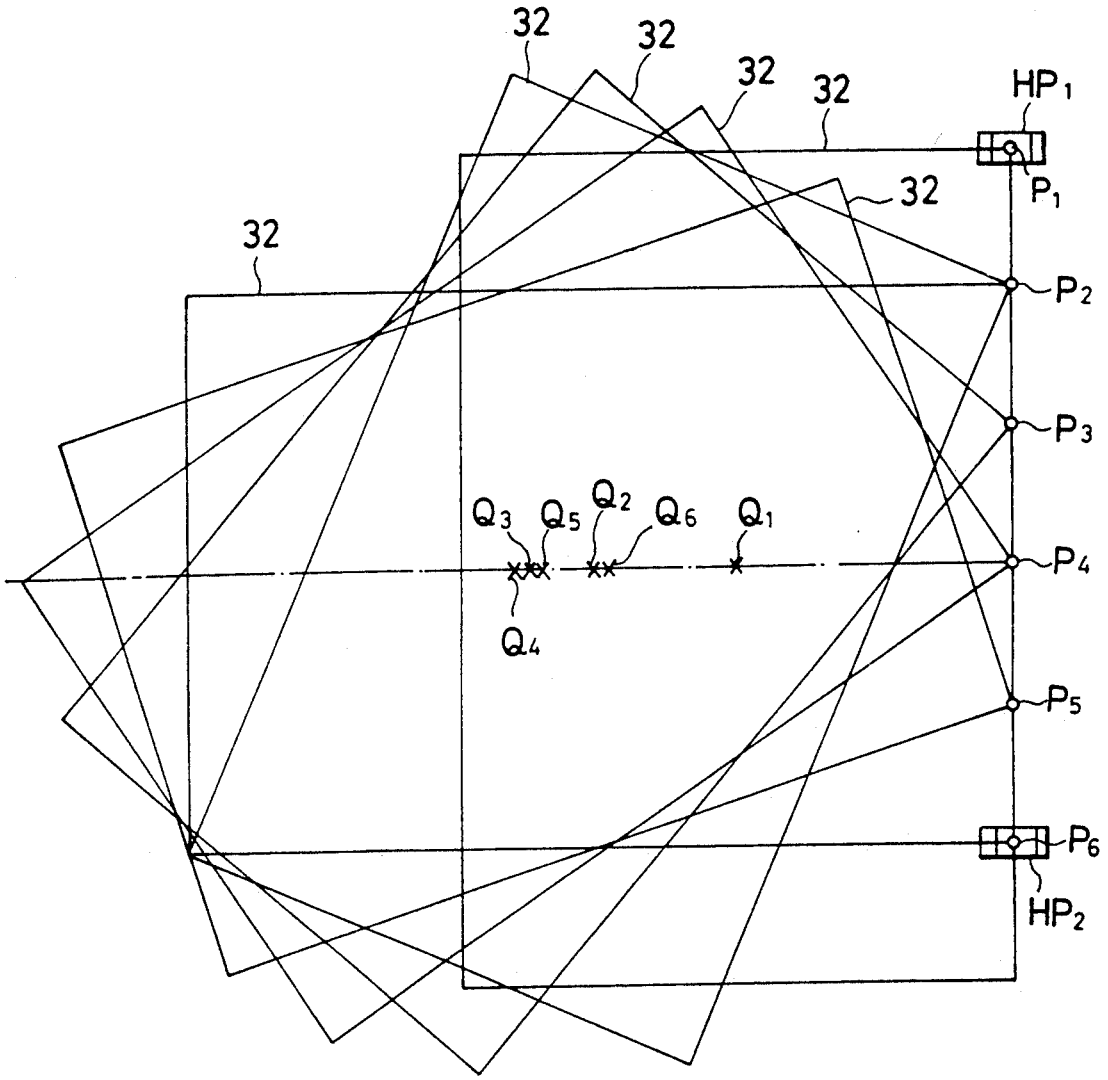
FIG. 8 is an explanation view of turning process of the turning cassette as shown in FIG. 1.

In the above construction, the turning motion of the turning cassette 32 will be first explained by way of an example of the first turning cassette unit 26 with reference to FIG. 8.

Assuming that the A4-sized sheets are stacked in the turning cassette 32 of the first turning cassette unit 26 and the tuning cassette 32 is at the lateral transport position (A4 position), the position sensor HP1 is turned ON and A4 is displayed on the portion corresponding to the first turning cassette unit 26 on the operation panel display device 56. In this case, the nut member 37 arranged on the threaded shaft 35 is assumed to be positioned at P1, as shown in FIG. 8.

Then, when the cassette turning key 48, corresponding to the first turning cassette unit 26, is operated from among the operation panel keys 55, the output terminal CW of the microcomputer 51 is turned high and the output terminal CCW is turned low. Thereby, the transistors Tr1, Tr4 are turned ON, the electric current runs by way of the +24 V power source, the transistor Tr1, the cassette turning motor 36, the transistor Tr4 and to ground in this order, and the cassette turning motor 36 rotates in a normal direction (the direction of C as shown in FIG. 3). As a result, the threaded shaft 35 also rotates in the C direction. The rotation moves the nut member 37 from P1 to P6. The guide axis 34 of the turning cassette 32 slides in the guide aperture 33*a* of the cassette supporting plate 33 with its rotation and reciprocates in the order of Q1 to Q6. When the nut member 37 arrives at the position sensor HP2 and the position sensor HP2 is turned ON, the cassette turning motor 36 is stopped. Then, the turning cassette 32 is positioned in a predetermined longitudinal transport position (A4R position).

When the cassette turning key 48 is operated again in this state, the output terminal CCW of the microcomputer 51 is turned high, the output terminal CW is turned low, and the transistors Tr2, Tr3 are turned ON. The electric current runs by way of the +24 V power source, the transistor Tr2, the cassette turning motor 36, the transistor Tr3 and to ground in this order and the cassette turning motor 36 reversely rotates. Therefore, the turning cassette 32 moves from the above longitudinal transport position to the lateral transport position through the process opposite to the above-mentioned case. Then, when the position sensor HP1 is turned ON, the cassette turning motor 36 stops and the turning cassette 32 is positioned at a predetermined lateral transport position.

Figure 9:
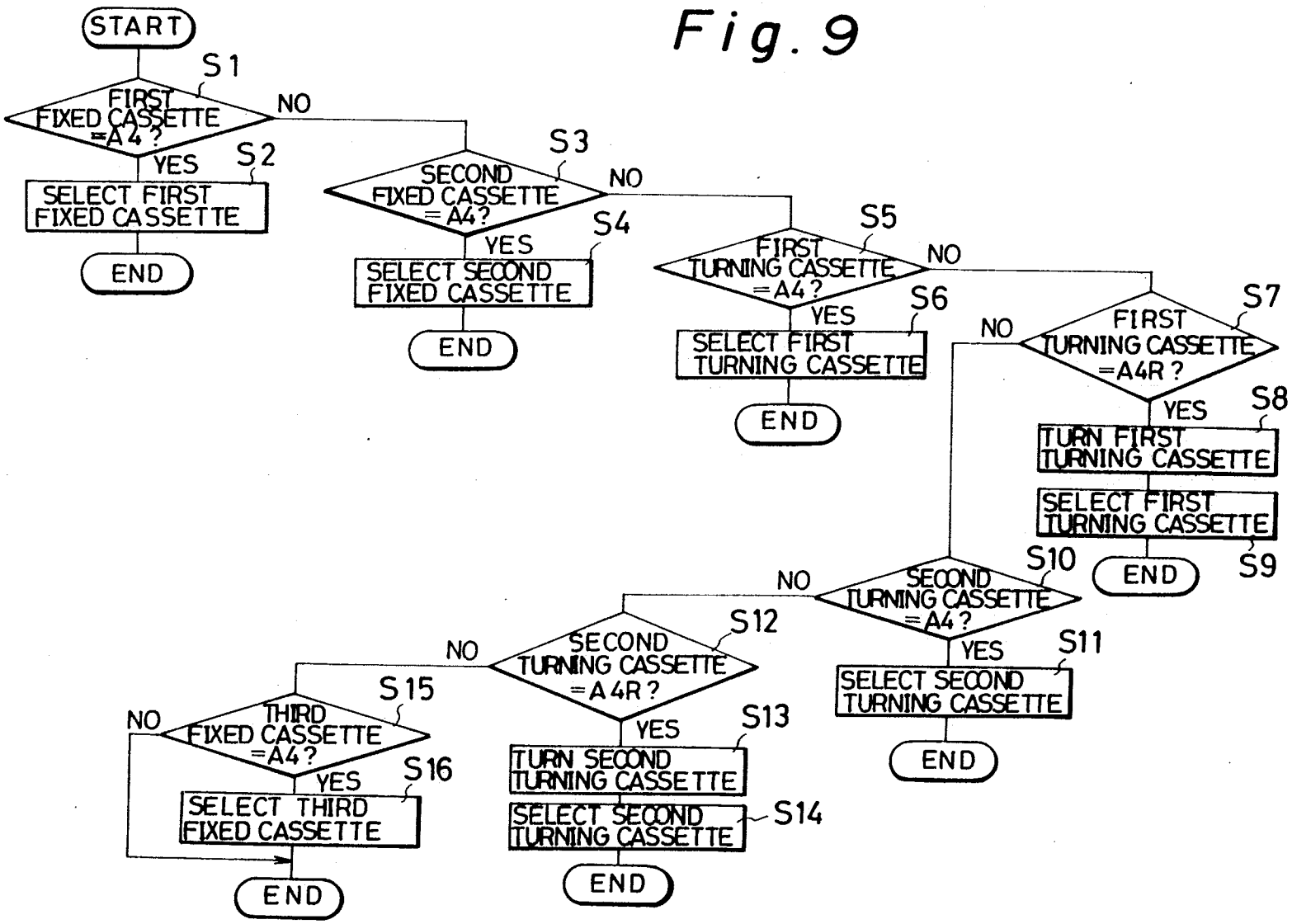
FIG. 9 is a flow chart showing a control operation of the sheet feeding device as shown in FIG. 1.

Next, referring to the flow chart shown in FIG. 9, the control operation of the microcomputer 51 for selecting a sheet feeding cassette for supplying a sheet to the paper stop roller 15 in the main body 1 of the copier will be explained.

When, for example, the A4 sheet (to be transported in the lateral direction) is selected by the automatic sheet selection function, it is judged whether or not the sheets stacked in the first fixed cassette 29, whose transport path to the paper stop roller 15 in the main body 1 is the shortest, are A4-sized (S1). If they are, the first fixed cassette 29 is selected (S2). If they are not, it is judged whether or not the sheets stacked in the second fixed cassette 28, whose sheet transport path is the second shortest, are A4-sized (S3). If they are, the second fixed cassette 28 is selected (S4). If they are not, it is judged whether or not the sheets stacked in the turning cassette 32 of the first turning cassette unit 26 are A4-sized (S5). If they are, the first cassette 32 of the first turning cassette unit 26 is selected (S6). If they are not A4-, but A4R-sized (S7), the turning cassette 32 of the first turning cassette unit 26 is turned to the lateral transport position so as to make the sheets A4 (S8), and the turning cassette 32 is selected (S9). If the sheets stacked in the turning cassette 32 of the first turning cassette unit 26 are not either A4- or A4R-sized, it is judged whether or not the sheets stacked in the turning cassette 32 of the second turning cassette unit 27 are A4-sized (S10). If they are, the turning cassette 32 of the second turning cassette unit 27 is selected (S11). If they are not A4-, but A4R-sized (S12), the turning cassette 32 of the second turning cassette unit 27 is turned to the lateral transport position so as to make the sheets A4-sized (S13) and the turning cassette 32 is selected (S14). If the sheets stacked in the turning cassette 32 of the second turning cassette unit 27 are not either A4- or A4R-sized, it is judged whether or not the sheets stacked in the third fixed cassette 25 and A4-sized (S15). If they are, the third fixed cassette 25 is selected (S16). If they are not, the selecting operation is finished.

According to the above-mentioned process, it is judged which cassette contains the selected sheets, in turn, starting from the first fixed cassette 29 whose sheet transport path is the shortest, in the order of the length of the sheet transport path. In this process, if the turning cassette 32 of the first turning cassette unit 26 or the second turning cassette unit 27 contains the sheets which are the same in the size but not the same in the transport direction as the selected sheets, the turning cassette 32 is turned so as to make the transport direction the same as that of the selected sheets. Therefore, it is possible to supply the sheet to the paper stop roller 15 through the shortest transport path, that is, in the shortest time.

As described above, the sheet feeding device of the embodiment can make the sheet transport path the shortest, that is, make the sheet transport time the shortest.

In the above described embodiment, the turning cassette 32 are utilized for placing the sheets, but instead, a movable plate or a movable bin, which has a plane for placing a sheet and moves to different transport positions, may be utilized. Further, instead of the turning motor 36, a solenoid, an air piston or any other driving device may be utilized.

In the above described embodiment, the sheet may be a sheet of paper, a sheet of film, or any other sheet of copying material.

Many widely different embodiments of the present invention may be constructed without departing from the spirit and scope of the present invention. It should be understood that the present invention is not limited to the specific embodiments described in this specification, except as defined in the appended claims.

What is claimed is:

1. A sheet feeding device for feeding a sheet to a sheet supply apparatus which designates a size and an orientation of the sheet, comprising:

a plurality of movable sheet placing means each having a plane for placing the sheet thereon and being movable to at least two transport positions corresponding to designated sheet orientations so as to transport the sheet therefrom in at least two designated sheet orientations;

a first detecting means for detecting the size of the sheet placed on each of said plurality of movable sheet placing means and outputting a first detection data on the sheet size;

an orientation detecting means for detecting the transport position of each of said plurality of movable sheet placing means and outputting an orientation data on the sheet orientation;

a plurality of fixed sheet placing means each having a plane for placing the sheet thereon and fixed in one transport position so as to transport the sheet therefrom in one orientation;

a second detecting means for detecting the size of the sheet placed on each of said plurality of fixed sheet placing means and outputting a second detection data on the sheet size;

a transportation means having a transport path for transporting a sheet from one of said plurality of movable and fixed sheet placing means to said sheet supply apparatus through said transport path; and a control means for judging whether or not the size and orientation of the sheet stacked in each of the sheet placing means are in accordance with the designated sheet size and the designated orientation in a sequence beginning with the sheet placing means having the shortest transport path to said sheet supply apparatus based on the first and second detection data and the orientation data supplied thereto respectively, and for selecting the one sheet placing means among said plurality of the fixed and movable sheet placing means determined to have the shortest transport path and designated size, the sheet size and the sheet orientation of said selected one sheet placing means being controlled in accordance with the designated sheet size and the designated sheet orientation, by moving a selected movable sheet placing means to the transport position corresponding to the designated sheet orientation when the sheet size of the selected movable sheet placing means is in accordance with the designated sheet size and the sheet orientation thereof is not in accordance with the designated sheet orientation, and controlling the transporting of the sheet from the selected sheet placing means to said sheet supply apparatus, whereby said transportation means transports the sheet from the placing means having the shortest path through the transport path.

2. A sheet feeding device according to claim 1, wherein the movable sheet placing means comprises a movable cassette, and the fixed sheet placing means comprises a fixed cassette.

3. A sheet feeding device according to claim 1, wherein said at least two transport positions includes a lateral transport position and a longitudinal transport position.

4. A sheet feeding device according to claim 1, wherein the movable sheet placing means is provided with a driving device.

5. A sheet feeding device according to claim 1, wherein the control means comprises a memory device for memorizing the transport position of each of the movable sheet placing means and the fixed sheet placing means and the size of the sheet placed on each of the movable sheet placing means and the fixed sheet placing means.

6. A sheet feeding device for selectively feeding sheets of a selectively designated size and orientation along the shortest available transport path to a sheet utilization apparatus, said device comprising:

a plurality of sheet supply devices for storing and supplying sheets of respectively different sizes and/or orientations;

said sheet supply devices being distributed along a common transport path towards said sheet utilization apparatus;

at least one of said sheet supply devices including means for selectively changing the orientation of sheets supplied therefrom; and means for detecting the orientation of sheets supplied by said at least one of said sheet supply devices, and control means for selecting the sheet supply device along said transport path closest to said sheet utilization device and which stores the designated sheet size including means responsive to said means for detecting to change the existing sheet orientation to the designated orientation when said existing orientation is different from said designated orientation and to thus provide the shortest possible sheet transport path for the designated sheet size and orientation.

* * * * *